US011866282B2

(12) United States Patent
Ebihara

(10) Patent No.: US 11,866,282 B2
(45) Date of Patent: Jan. 9, 2024

(54) SHEET STACKER AND IMAGE FORMING SYSTEM

(71) Applicant: Takashi Ebihara, Ibaraki (JP)

(72) Inventor: Takashi Ebihara, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/969,135

(22) Filed: Oct. 19, 2022

(65) Prior Publication Data

US 2023/0150787 A1 May 18, 2023

(30) Foreign Application Priority Data

Nov. 12, 2021 (JP) ..... 2021-184888

(51) Int. Cl.
*B65H 31/10* (2006.01)
*B65H 43/00* (2006.01)
(Continued)

(52) U.S. Cl.
CPC ..... *B65H 31/10* (2013.01); *B65H 31/20* (2013.01); *B65H 31/34* (2013.01); *B65H 43/00* (2013.01);
(Continued)

(58) Field of Classification Search
CPC ..... B65H 31/08; B65H 31/20; B65H 31/34; B65H 2301/36; B65H 2301/362; B65H 2301/3613; B65H 2301/363; B65H 2511/12; B65H 2404/72; B65H 2404/73; B65H 2404/732; B65H 2553/80; B65H 2701/1313; B65H 2701/132
(Continued)

(56) References Cited

U.S. PATENT DOCUMENTS 4,657,239 A * 4/1987 Ikesue ..... B65H 9/101 271/227
5,441,247 A * 8/1995 Quilliam ..... B65H 5/24 271/10.04
(Continued)

FOREIGN PATENT DOCUMENTS

JP 2000-118729 4/2000
JP 2004-123396 4/2004
(Continued)

*Primary Examiner* — Leslie A Nicholson, III
(74) *Attorney, Agent, or Firm* — Harness, Dickey & Pierce, P.L.C.

(57) ABSTRACT

A sheet stacker includes a sheet stacking portion, a pair of sheet restrictors, a sheet feeder, and a position detector. A bundle of sheets is stacked on the sheet stacking portion in a stacking direction, and the sheet stacking portion moves in the stacking direction. The pair of sheet restrictors move in a width direction to regulate a position of the bundle of sheets in the width direction. The sheet feeder feeds a top sheet of the bundle of sheets at a sheet feeding position in a sheet feeding direction. The sheet feeding position is disposed at a top of the bundle of sheets in the stacking direction. The position detector is disposed between the pair of sheet restrictors in the width direction and above the sheet feeding position in the stacking direction. The position detector detects a position of the pair of sheet restrictors in the width direction.

20 Claims, 8 Drawing Sheets

(51) Int. Cl.
*B65H 31/20* (2006.01)
*B65H 31/34* (2006.01)

(52) U.S. Cl.
CPC .... *B65H 2404/741* (2013.01); *B65H 2511/12* (2013.01); *B65H 2553/00* (2013.01); *B65H 2553/80* (2013.01); *B65H 2701/1313* (2013.01)

(58) Field of Classification Search
USPC ..... 271/145, 162, 171
See application file for complete search history.

(56) References Cited

U.S. PATENT DOCUMENTS 6,543,761 B2 * 4/2003 Endo ..... B65H 3/5223 271/111
7,367,642 B2 * 5/2008 Ouchi ..... B41J 11/0095 347/14
7,413,188 B2 * 8/2008 Miki ..... B65H 1/266 271/171
7,775,519 B2 * 8/2010 Takahashi ..... B65H 7/00 271/265.02
7,916,359 B2 * 3/2011 Horade ..... B41J 11/0095 358/509
7,934,713 B2 * 5/2011 Suzuki ..... B65H 31/34 270/58.11
9,499,366 B2 * 11/2016 Morikami ..... B65H 1/266
9,580,259 B1 * 2/2017 McFarland ..... B65H 1/266
9,926,153 B2 * 3/2018 Kubota ..... B65H 43/04
2005/0196211 A1 9/2005 Miki
2019/0062090 A1 * 2/2019 Maehara ..... B65H 1/04
2022/0073308 A1 3/2022 Ebihara

FOREIGN PATENT DOCUMENTS

JP 2005-280994 10/2005
JP 2010-024057 2/2010
JP 2010-058889 3/2010

* cited by examiner

SHEET STACKER AND IMAGE FORMING SYSTEM

CROSS-REFERENCE TO RELATED APPLICATION

This patent application is based on and claims priority pursuant to 35 U.S.C. § 119(a) to Japanese Patent Application No. 2021-184888, filed on Nov. 12, 2021, in the Japan Patent Office, the entire disclosure of which is hereby incorporated by reference herein.

BACKGROUND

Technical Field

Embodiments of the present disclosure relate to a sheet stacker and an image forming system.

Related Art

A sheet stacker that includes a sheet stacking portion, a pair of sheet restrictors, and a position detector is known. Sheets are stacked on the sheet stacking portion, and the sheet stacking portion moves up and down. The pair of sheet restrictors is movable in a width direction of the sheets to regulate a position of the sheets stacked on the sheet stacking portion in the width direction. The position detector is disposed between the pair of sheet restrictors to detect a position of the sheet restrictor in the width direction.

SUMMARY

Embodiments of the present disclosure describe an improved sheet stacker that includes a sheet stacking portion, a pair of sheet restrictors, a sheet feeder, and a position detector. A bundle of sheets is stacked on the sheet stacking portion in a stacking direction, and the sheet stacking portion moves in the stacking direction. The pair of sheet restrictors move in a width direction of the bundle of sheets orthogonal to the stacking direction to regulate a position of the bundle of sheets in the width direction. The sheet feeder feeds a top sheet of the bundle of sheets at a sheet feeding position in a sheet feeding direction orthogonal to the stacking direction and the width direction. The sheet feeding position is disposed at a top of the bundle of sheets in the stacking direction. The position detector is disposed between the pair of sheet restrictors in the width direction and above the sheet feeding position in the stacking direction. The position detector detects a position of the pair of sheet restrictors in the width direction.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
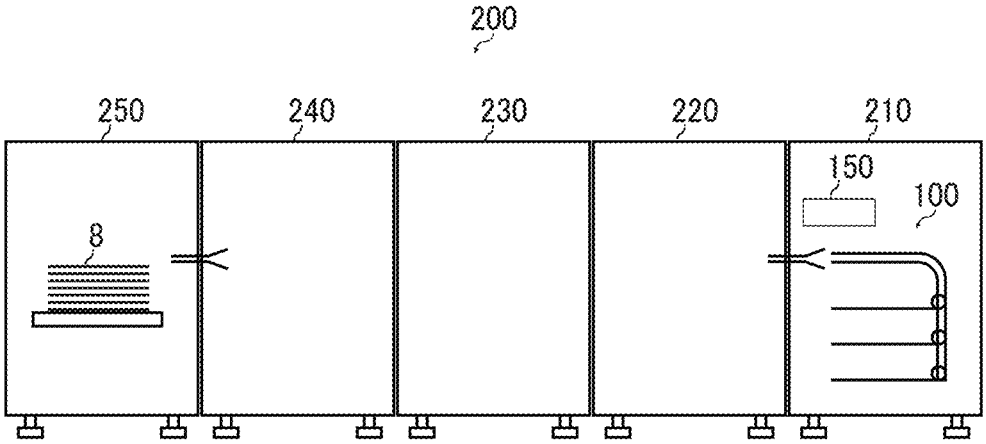
FIG. 1 is a schematic view of an image forming system according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given below of an image forming system according to an embodiment of the present disclosure. In the present embodiment, the image forming system includes a sheet feeding device that is a sheet stacker including a sheet feeder. FIG. 1 is a schematic view of an image forming system 200 according to the present embodiment. The image forming system 200 includes a sheet feeding device 210, a pretreatment liquid application device 220, an inkjet printer 230, a drying device 240, and a sheet output device 250.

The sheet feeding device 210 supplies a sheet 8 as a recording medium such as cut paper to the pretreatment liquid application device 220 disposed downstream from the sheet feeding device 210 in a conveyance path of the sheet 8. The sheet feeding device 210 as a sheet stacker includes a sheet feeding tray 100 and a controller 150, which are described later. The pretreatment liquid application device 220 applies a pretreatment liquid to the sheet 8. The pretreatment liquid prevents blurring and bleed-through of inkjet ink for printing. The pretreatment liquid application device 220 includes a sheet reverse path to reverse the sheet 8. The pretreatment liquid is applied to a front side of the sheet 8. Thereafter, the sheet 8 is reversed in the sheet reverse path, and the pretreatment liquid is also applied to a back side of the sheet 8 in double-sided printing.

The inkjet printer 230 as an image forming device discharges ink droplets onto the front side of the sheet 8 to which the pretreatment liquid has been applied by the pretreatment liquid application device 220 to form a desired image. The drying device 240 includes a dryer that dries the image on the front side of the sheet 8 formed by the inkjet printer 230. In double-sided printing of the sheet 8, the sheet 8 is reversed in a path from the drying device 240 back to the inkjet printer 230. Then, the inkjet printer 230 discharges ink droplets to a front side (i.e., the back side before reversed) of the reversed sheet 8 to form a desired image, and the drying device 240 dries the image on the front side (i.e., the back side before reversed) of the sheet 8. Thereafter, the sheet 8 is ejected to the sheet output device 250.

Figure 2A:
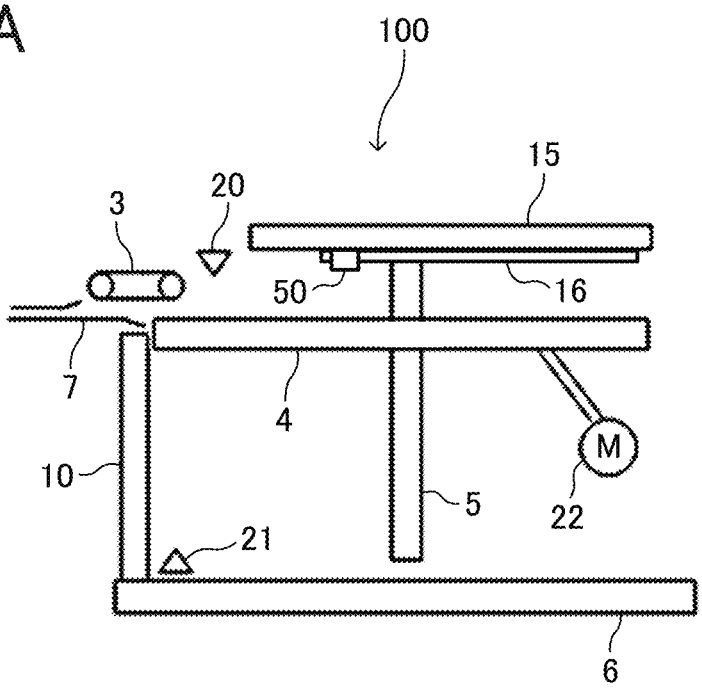
FIGS. 2A and 2B are schematic views of a sheet feeding tray of a sheet feeding device of the image forming system in FIG. 1.
Figure 2B:
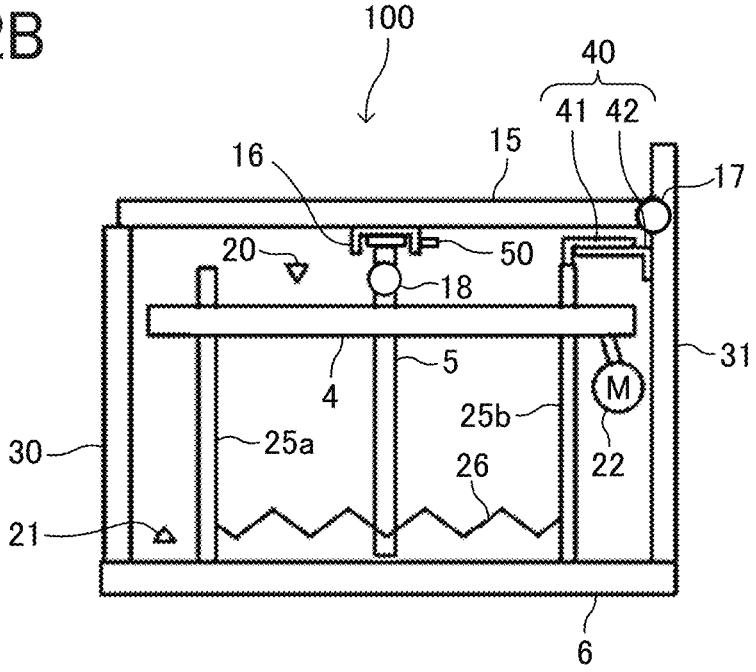

FIGS. 2A and 2B are schematic views of the sheet feeding tray 100 of the sheet feeding device 210. FIG. 2A is a front view of the sheet feeding tray 100, and the sheet 8 is fed from right to left in FIG. 2A. FIG. 2B is a right side view of the sheet feeding tray 100. The left-right direction in FIG. 2B is the front-back direction of the sheet feeding device 210 and a width direction of the sheet 8.

The sheet feeding tray 100 includes a bottom portion 6, a left side plate 10 disposed on the downstream side in a sheet feeding direction, a front side plate 30 disposed on the front side of the sheet feeding device 210, a back side plate 31 disposed on the back side of the sheet feeding device 210, which construct a device body of the sheet feeding device 210. Thus, the sheet feeding tray 100 has a box shape in which an upper portion and a right side are opened. The sheet feeding device 210 further includes a lift table 4 as a sheet stacking portion that moves up and down (i.e., a stacking direction) by a motor 22. Position sensors 20 and 21 are disposed above and below a range where the lift table 4 is movable in the vertical direction, respectively. When the lift table 4 moves upward, the position sensor 20 detects the upper surface of the lift table 4, and the lift table 4 stops at a predetermined position based on the detection result of the position sensor 20. Similarly, when the lift table 4 moves downward, the position sensor 21 detects the lower surface of the lift table 4, and the lift table 4 stops at a predetermined position based on the detection result of the position sensor 21.

Side fences 25*a* and 25*b* as a pair of sheet restrictors are disposed on both sides of the lift table 4 in the width direction of the sheet 8 (the front-back direction of the sheet feeding device 210) orthogonal to the stacking direction, and the positions of the pair of side fences 25*a* and 25*b* are moved in accordance with the sheet 8 set on the lift table 4. The pair of side fences 25*a* and 25*b* move in opposite directions in the width direction of the sheet 8 in conjunction with each other by a connector 26. Each of the side fences 25*a* and 25*b* regulates the position of the edge of the sheet 8 in the width direction.

The sheet feeding tray 100 further includes a fixing mechanism 40 as a fixing unit that locks the side fences 25*a* and 25*b* to immobilize the side fences 25*a* and 25*b* in the width direction. The fixing mechanism 40 includes a slide plate 41 attached to the side fence 25*b* on the right side in FIG. 2B (i.e., the back side of the sheet feeding device 210), and a fixing plate 42 secured to the back side plate 31. When the slide plate 41 is secured to the fixing plate 42, the side fences 25*a* and 25*b* are locked so as not to move in the width direction.

An end fence 5 is disposed at a position corresponding to a trailing end of the sheet 8. The end fence 5 serves as a trailing-end restrictor that is movable to regulate the position of the trailing end of the sheet 8. The end fence 5 regulates the position of the trailing end of the sheet 8 while a leading end of the sheet 8 contacts the left side plate 10 that is disposed on the downstream side of the sheet feeding tray 100 in the sheet feeding direction. The end fence 5 is held by a guide rail 16 serving as a stay disposed at an upper portion of the sheet feeding tray 100. The end fence 5 is movable along the guide rail 16 in a longitudinal direction of the guide rail 16 (i.e., the sheet feeding direction).

The guide rail 16 is attached to a guide frame 15 as a frame. The guide frame 15 has a frame shape that is along an edge of the box-shaped sheet feeding tray 100. Specifically, the guide rail 16 is attached to the center in the width direction of an upstream side support portion of the guide frame 15. The upstream side support portion extends in the sheet width direction on the upstream side of the guide frame 15 in the sheet feeding direction. The guide frame 15 is hinged on (swingably attached to) the back side plate 31 via a plurality of rotating hinges 17 which is rotatable. The end fence 5 moves along the guide rail 16 in the sheet feeding direction and is secured at a desired position in the longitudinal direction of the guide rail 16. The end fence 5 is secured at the desired position in response to various sizes of the sheet 8. The end fence 5 includes a rotating hinge 18, which is rotatable, therein.

A rangefinder 50 as a position detector is attached to the guide rail 16 to measure a distance to detect the position of the side fence 25*b* in the width direction. In the present embodiment, an infrared rangefinder is used as the rangefinder 50. The rangefinder 50 emits, but not limited to, infrared light and may emit visible light or ultraviolet light. The rangefinder 50 may use radio waves such as millimeter waves or ultrasonic waves. The rangefinder 50 detects the position of the side fence 25*b* to detect a width of the sheet 8 set on the sheet feeding tray 100 based on the detected position.

As the lift table 4 moves upward, the position sensor 20 detects that a top sheet 8 of a bundle of sheets 8 stacked on the lift table 4 reaches a sheet feeding position, and the lift table 4 stops at the position in response to the detection of the position sensor 20. A plurality of pickup belts 3 is faces the downstream side portion of the lift table 4 in the sheet feeding direction. The pickup belt 3 has a plurality of suction holes, and the top sheet 8 at the sheet feeding position is attracted onto the pickup belt 3 by the suction fan. Thus, when sheets 8 are stacked on the lift table 4, the sheets 8 are fed one by one in the sheet feeding direction orthogonal to the stacking direction and the width direction by the pickup belt 3. The pickup belt 3, the suction fan, and the driver of the pickup belt 3 construct a sheet feeder.

Figure 3:
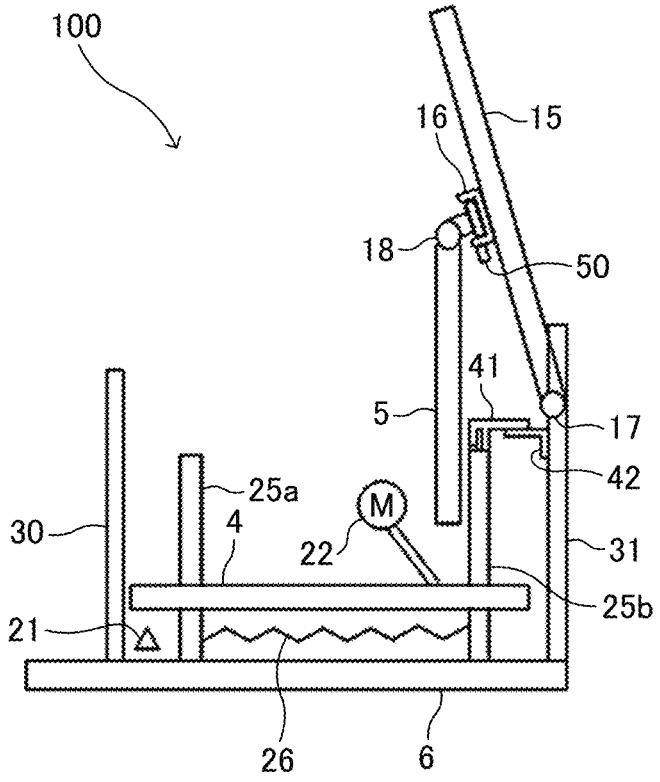
FIG. 3 is a schematic view of the sheet feeding tray, illustrating an example of movement of a guide frame and an end fence when a sheet is set on the sheet feeding tray.

FIG. 3 is a schematic view of the sheet feeding tray 100, illustrating an example of movement of the guide frame 15 and the end fence 5 when the sheet 8 is set on the lift table 4. The lift table 4 is lowered by the motor 22, the position sensor 21 detects the position of the lift table 4, and then the lift table 4 is stopped. The sheet feeding tray 100 is pulled out from the sheet feeding device 210, and the guide frame 15 is swung upward around the plurality of rotating hinges 17. At that time, the guide rail 16 secured to the guide frame 15 is also lifted together. The end fence 5 coupled to the guide rail 16 is moved and retracted in the vertical direction while being swung around the rotating hinge 18, so that the end fence 5 does not hinder the sheet 8 from being set on the lift table 4. The rotating hinge 17 applies torque to the guide frame 15 against only a direction in which the guide frame 15 is swung downward. Accordingly, when an operator sets the sheet 8 on the lift table 4, the guide frame 15 is not automatically swung downward even if the operator does not hold the guide frame 15 by hand.

The side fences 25*a* and 25*b* are moved in response to the width of the sheet 8 set on the lift table 4, and the guide frame 15 is swung downward around the rotating hinge 17, thereby changing the angle of the guide frame 15. The end fence 5 keeps a vertical posture around the rotating hinge 18 under gravity. Accordingly, when the guide frame 15 is swung downward, the end fence 5 returns to a predetermined position. Then, the end fence 5 and the side fences 25*a* and 25*b* are moved to suitable positions for the length and width of the sheet 8 set on the lift table 4.

Figure 4A:
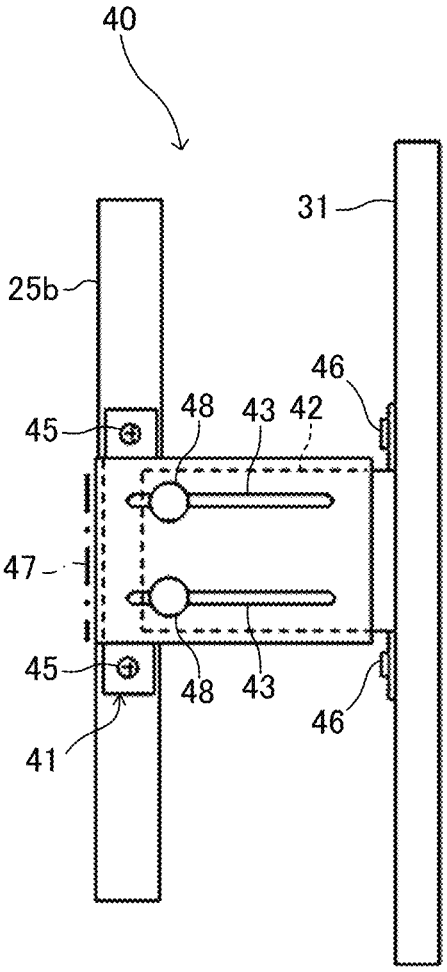
FIGS. 4A and 4B are schematic views of a fixing mechanism of the sheet feeding tray.
Figure 4B:
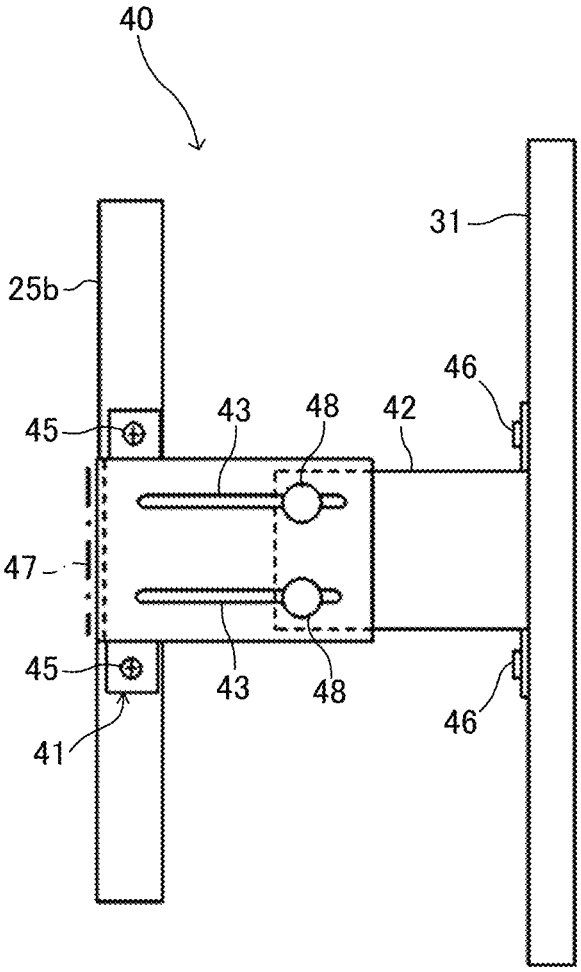

FIGS. 4A and 4B are schematic views of the fixing mechanism 40. FIG. 4A illustrates the fixing mechanism 40 when sheets having a maximum size in the width direction that can be stacked on the sheet feeding tray 100 are set. FIG. 4B illustrates the fixing mechanism 40 when sheets having a minimum size in the width direction that can be stacked on the sheet feeding tray 100 are set.

The fixing mechanism 40 includes the slide plate 41 as a second component attached to the side fence 25*b* on the back side of the sheet feeding device 210, and the fixing plate 42 as a first component secured to the back side plate 31 which is a side face of the device body of the sheet feeding device 210.

The slide plate 41 is formed of a metal sheet and secured to an upper portion of the side fence 25*b* by screws 45. Two slotted holes 43 extend in the width direction at a predetermined interval in the sheet feeding direction. As illustrated in FIGS. 4A and 4B, the slotted hole 43 is longer than a movement range of the side fence 25*b* in the width direction, in which the side fence 25*b* is movable from a position for regulating the sheet having the maximum width to a position for regulating the sheet having the minimum width.

The fixing plate 42 is formed of a sheet metal and secured to the back side plate 31 by screws 46. A back side portion (on the right side in FIGS. 4A and 4B) of the slide plate 41 is placed on the fixing plate 42. Two screw holes into which screws 48 as fastening members are screwed are disposed in the vicinity of the front end (on the left side in FIGS. 4A and 4B) of the fixing plate 42 at a predetermined interval in the sheet feeding direction. Each screw 48 passes through the slotted hole 43 of the slide plate 41 and is screwed into the screw hole of the fixing plate 42.

As each screw 48 is loosened, the side fence 25*b* can move in the width direction. When the side fence 25*b* slides in the width direction, the slide plate 41 moves in the width direction relative to the fixing plate 42. After the side fences 25*a* and 25*b* contact the edge of the stacked sheets 8 in the width direction to regulate the position of the sheets 8 in the width direction, the screws 48 are tightened to fasten the slide plate 41 to the fixing plate 42, thereby immobilizing the side fences 25*b* in the width direction. In the present embodiment, the pair of side fences 25*a* and 25*b* are moved in conjunction with each other by the connector 26. Accordingly, when one side fence 25*b* is locked, the other side fence 25*a* is also locked so as not to move.

An end portion of the slide plate 41 adjacent to the side fence 25*b* is bent downward by 90 degrees, and the bent face serves as a detection portion 47 detectable by the rangefinder 50 to detect the position of the side fence 25*b*. The slide plate 41 is formed of the sheet metal that is a material on which infrared light is sufficiently reflected. Accordingly, with the detection portion 47 of the slide plate 41, the rangefinder 50 can reliably detect the position of the side fence 25*b*.

Figure 5:
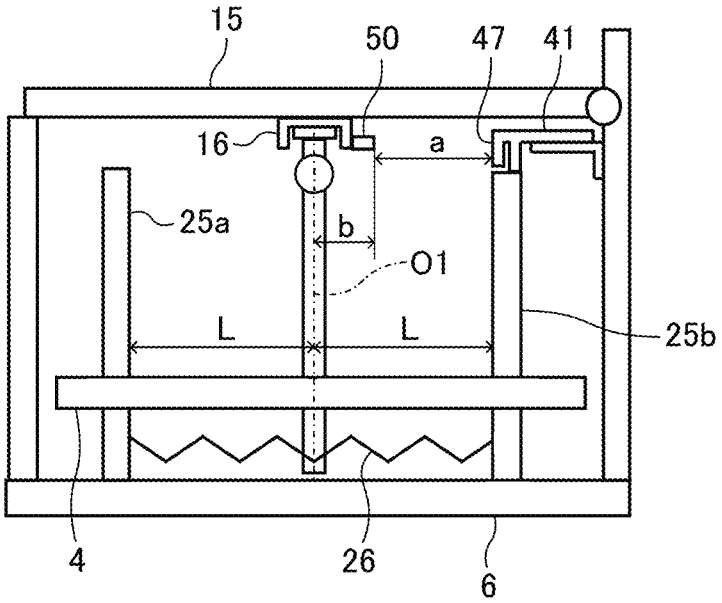
FIG. 5 is a schematic view of the sheet feeding tray, illustrating detection of a position of a side fence in a width direction by a rangefinder of the sheet feeding tray.

FIG. 5 is a schematic view of the sheet feeding tray 100, illustrating detection of the position of the side fence 25*b* in the width direction by the rangefinder 50. The pair of side fences 25*a* and 25*b* are moved by the same amount in opposite directions in the width direction by the connector 26. Accordingly, the side fence 25*a* on the left side in FIG. 5 (i.e., the front side of the sheet feeding device 210) and the side fence 25*b* on the right side in FIG. 5 (i.e., the back side of the sheet feeding device 210) are constantly positioned away from a center O1 of the sheet feeding tray 100 by the same distance L in the width direction.

The rangefinder 50 is attached to a right side face of the guide rail 16 as a stay in FIG. 5, and is disposed at a position shifted from the center O1 by a distance b (mm) toward the right in FIG. 5 in the width direction. Therefore, the distance L is obtained by adding the distance b to a distance a (mm) that is the length from the rangefinder 50 to the side fence 25*b* measured by the rangefinder 50 (i.e., L=a+b). The distance b (mm) from the center O1 to the rangefinder 50 is constant. The distance b (mm) is measured in advance and stored in a nonvolatile memory of the sheet feeding device 210. Using the distance a (mm) measured by the rangefinder 50 and the distances b (mm) from the center O1 to the rangefinder 50 stored in the nonvolatile memory, the distance L (i.e., positions of the side fences 25*a* and 25*b* relative to the center O1) is obtained. Accordingly, the width of the sheets 8 set on the sheet feeding tray 100 is equal to 2L calculated based on the distance L (i.e., positions of the side fences 25*a* and 25*b*).

In the present embodiment, the rangefinder 50 is secured to the guide rail 16 disposed at the center of the upper portion of the sheet feeding tray 100 in the width direction. Thus, as compared with the case in which the rangefinder 50 is disposed at one end of the sheet feeding tray 100 in the width direction, the rangefinder 50 measures a shorter distance from the rangefinder 50 to the side fence 25*b*. Accordingly, the distance a from the rangefinder 50 to the side fence b can be detected with high accuracy even if an inexpensive rangefinder having a short measurement range is used.

In the present embodiment, the pair of side fences 25*a* and 25*b* are moved by the same distance in opposite directions in the width direction by the connector 26. Thus, as described with reference to FIG. 5, by measuring the distance a from the one side fence 25*b* by the rangefinder 50, the width of the sheet 8, i.e., 2L=2 (a+b), set on the sheet feeding tray 100 can be detected. As a result, the measurement range of the rangefinder 50 can be shortened as compared with a comparative configuration in which the rangefinder measures the distance between the side fences 25*a* and 25*b* to detect the width of the sheet 8. Therefore, the width of the sheet 8 can be detected by an inexpensive rangefinder having a short measurement range.

Figure 6A:
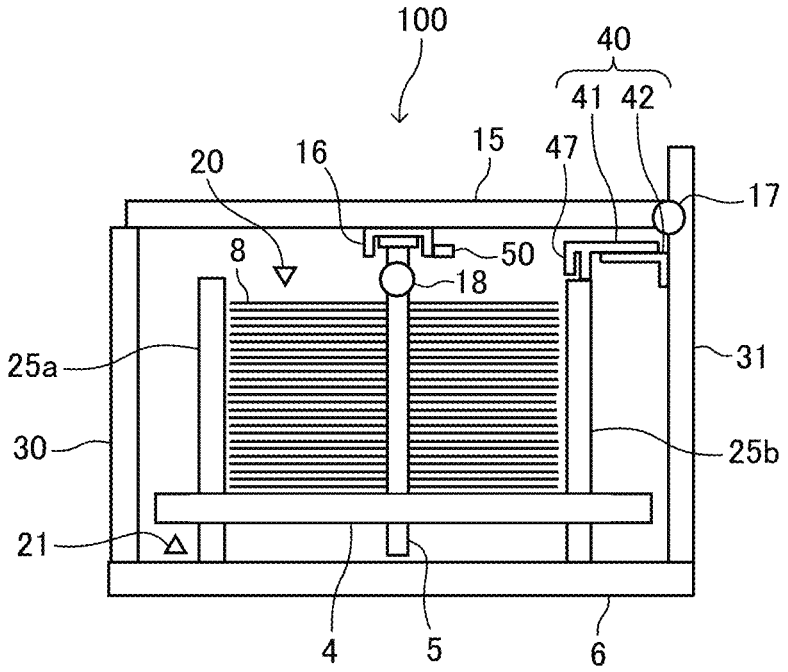
FIGS. 6A and 6B are schematic views of the sheet feeding tray on which sheets having the maximum width are stacked.
Figure 6B:
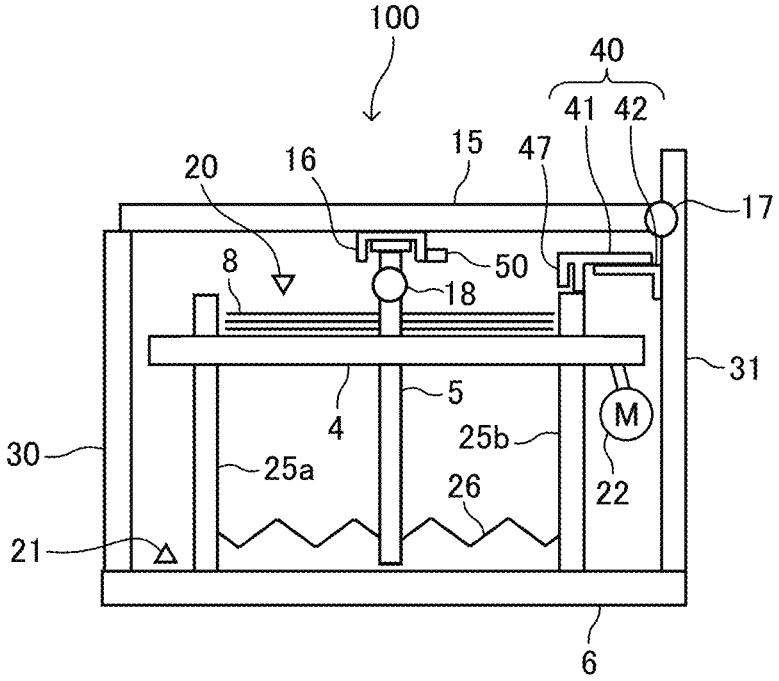

FIGS. 6A and 6B are schematic views of the sheet feeding tray 100 on which a bundle of sheets 8 having the maximum width are stacked. FIG. 6A illustrates a state in which the maximum number of sheets 8 that can be stacked on the sheet feeding tray 100 are set on the lift table 4, and FIG. 6B illustrates a state in which the several sheets 8 remain on the lift table 4.

When the bundle of sheets 8 having the maximum width is set on the sheet feeding tray 100, the lift table 4 is lowered to a position at which the position sensor 21 detects the lift table 4. The screws 48 of the fixing mechanism 40 illustrated in FIG. 4 are loosened, and the side fences 25*a* and 25*b* are moved to the end portions in the width direction. After the bundle of sheets 8 is set on the sheet feeding tray 100, the side fences 25*a* and 25*b* are slid in the width direction and brought into contact with an edge of the bundle of sheets 8 in the width direction stacked on the lift table 4. After the side fences 25*a* and 25*b* contact the edge of the sheets 8 to regulate the position of the sheets 8 in the width direction, the screws 48 are tightened to lock the side fences 25*a* and 25*b*. At that time, the slide plate 41 is fastened to the fixing plate 42 as illustrated in FIG. 4A. The end fence 5 moves in the sheet feeding direction and contacts the trailing end of the sheets 8 to regulate the position of the trailing end of the sheets 8.

The rangefinder 50 measures the distance a from the rangefinder 50 to the detection portion 47 of the slide plate 41 to detect that the width of the sheets 8 stacked on the lift table 4 is the maximum width based on the measured distance a.

The lift table 4 is raised based on the detection result of the position sensor 20. Specifically, when the position sensor 20 does not detect the upper surface of the bundle of sheets 8 stacked on the lift table 4, the lift table 4 starts moving upward, and when the position sensor 20 detects the upper surface of the bundle of sheet 8 stacked on the lift table 4, the lift table 4 stops moving upward.

At the sheet feeding position at which the position sensor 20 detects the upper surface of the bundle of sheets 8, the top sheet 8 of the bundle of sheets 8 is floated by the suction force of the suction fan and attracted onto the pickup belt 3 illustrated in FIG. 2. Then, the sheet 8 attracted onto the pickup belt 3 by the suction force of the suction fan is fed to a guide plate 7 by the pickup belt 3.

Figure 7A:
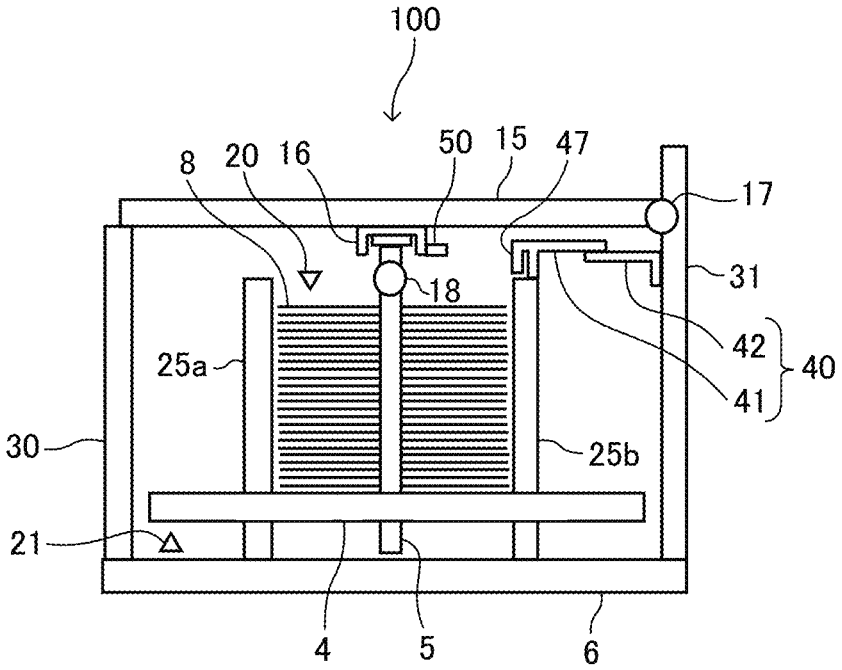
FIGS. 7A and 7B are schematic views of the sheet feeding tray on which sheets having the minimum width are stacked.
Figure 7B:
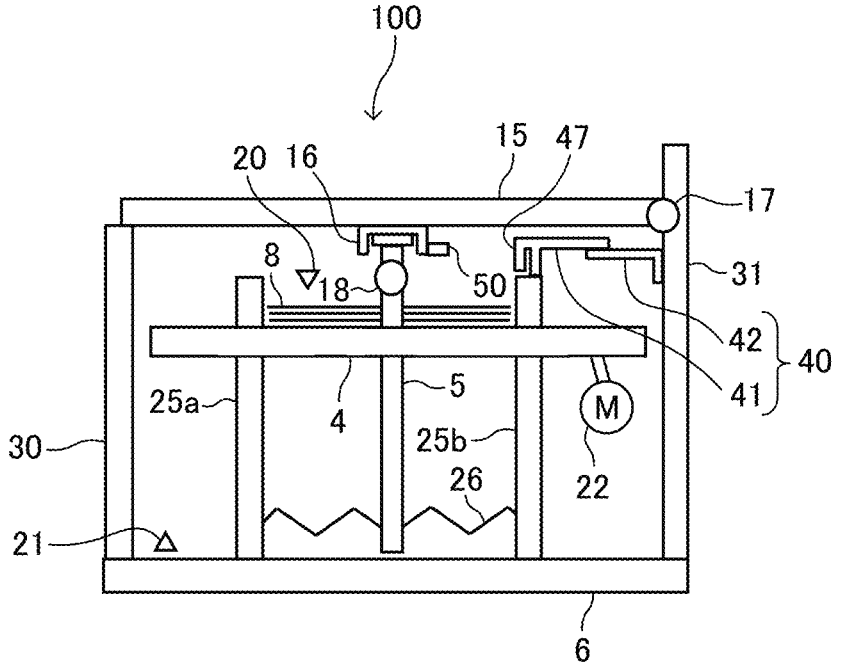

FIGS. 7A and 7B are schematic views of the sheet feeding tray 100 on which a bundle of sheets 8 having the minimum width are stacked. FIG. 7A illustrates a state in which the maximum number of sheets 8 that can be stacked on the sheet feeding tray 100 are set on the lift table 4, and FIG. 7B illustrates a state in which the several sheets 8 remain on the lift table 4.

When the bundle of sheets 8 having the minimum width is set on the sheet feeding tray 100, the lift table 4 is lowered to a position at which the position sensor 21 detects the lift table 4, and the bundle of sheets 8 having the minimum width is set on the sheet feeding tray 100. After the bundle of sheets 8 having the minimum width is set on the sheet feeding tray 100, the side fences 25*a* and 25*b*, which are slidable by loosening the screws 48, are slid in the width direction and brought into contact with an edge of the bundle of sheets 8 in the width direction stacked on the lift table 4 to regulate the position of the sheets 8 in the width direction. Then, the screws 48 are tightened to lock the side fences 25*a* and 25*b*. At that time, the slide plate 41 is fastened to the fixing plate 42 as illustrated in FIG. 4B. The end fence 5 moves in the sheet feeding direction and contacts the trailing end of the sheets 8 to regulate the position of the trailing end of the sheets 8.

The rangefinder 50 measures the distance a from the rangefinder 50 to the detection portion 47 of the slide plate 41 to detect that the width of the sheets 8 stacked on the lift table 4 is the minimum width based on the measured distance a.

The lift table 4 is raised based on the detection result of the position sensor 20. Specifically, when the position sensor 20 does not detect the upper surface of the bundle of sheets 8 stacked on the lift table 4, the lift table 4 starts moving upward, and when the position sensor 20 detects the upper surface of the bundle of sheet 8 stacked on the lift table 4, the lift table 4 stops moving upward.

If the rangefinder 50 is disposed on the bottom portion 6 of the sheet feeding tray 100, the rangefinder 50 is preferably positioned so as to avoid the connector 26 disposed above the bottom portion 6. Thus, an arrangement position of the rangefinder 50 may be limited. Further, waste such as paper powder from the sheets 8 set on the lift table 4, dust, or dirt accumulates on the bottom portion 6 of the sheet feeding tray 100 over time. If such waste accumulates on the optical axis of the rangefinder 50, the light of the rangefinder 50 may be blocked by the waste, and the distance a to the side fence 25*b* may not be measured.

To avoid the measurement failure of the rangefinder 50 due to the accumulating waste, a mount on which the rangefinder 50 is mounted may be installed on the bottom portion 6, and the rangefinder 50 may be disposed at a position one step higher than the bottom portion 6. In such a configuration, the lowermost position of the lift table 4 may be changed upward to prevent the lift table 4 from colliding with the rangefinder 50. As a result, the maximum number of sheets 8 that can be stacked on the lift table 4 may be reduced.

On the other hand, in the present embodiment, the rangefinder 50 is secured to the guide rail 16 disposed at the upper portion of the sheet feeding tray 100. Thus, the rangefinder 50 can be positioned above the sheet feeding position which is the highest position of the sheets 8 stacked on the lift table 4 in the height direction. As a result, the rangefinder 50 can be constantly positioned above the sheets 8 stacked on the lift table 4. Therefore, as illustrated in FIGS. 6A to 7B, the rangefinder 50 does not interfere with the sheets 8 stacked on the lift table 4 in any situation. Further, the rangefinder 50 can reliably measure the distance a to the side fence 25*b* above the sheets 8 stacked on the lift table 4 without the light of the rangefinder 50 being blocked by the sheets 8 stacked on the lift table 4.

The pickup belt 3 is disposed on the downstream side in the sheet feeding direction above the sheet feeding position, and a certain space is disposed on the upstream side of the pickup belt 3 above the sheet feeding position. Therefore, the rangefinder 50 can be disposed in the certain space without upsizing the sheet feeding tray 100 in the vertical direction.

Unlike the bottom portion 6, waste, such as paper powder or dust, adhering to the bundle of sheets 8 does not fall on the upper surface of the bundle of sheets 8 stacked on the lift table 4. Accordingly, the waste is less likely to accumulate on the upper surface of the bundle of sheets 8 than on the bottom portion 6. Even if waste adheres to the upper surface of the bundle of sheets 8, when the top sheet 8 of the bundle of sheets 8 is fed, the waste adhering to the upper surface of the bundle of sheets 8 is conveyed together with the top sheet 8. Thus, unlike the bottom portion 6, almost no dust accumulates on the upper surface of the bundle of sheets 8. Therefore, the light of the rangefinder 50 is not blocked by the accumulating waste, and the rangefinder 50 can reliably measure the distance a to the side fence 25*b*.

Figure 8:
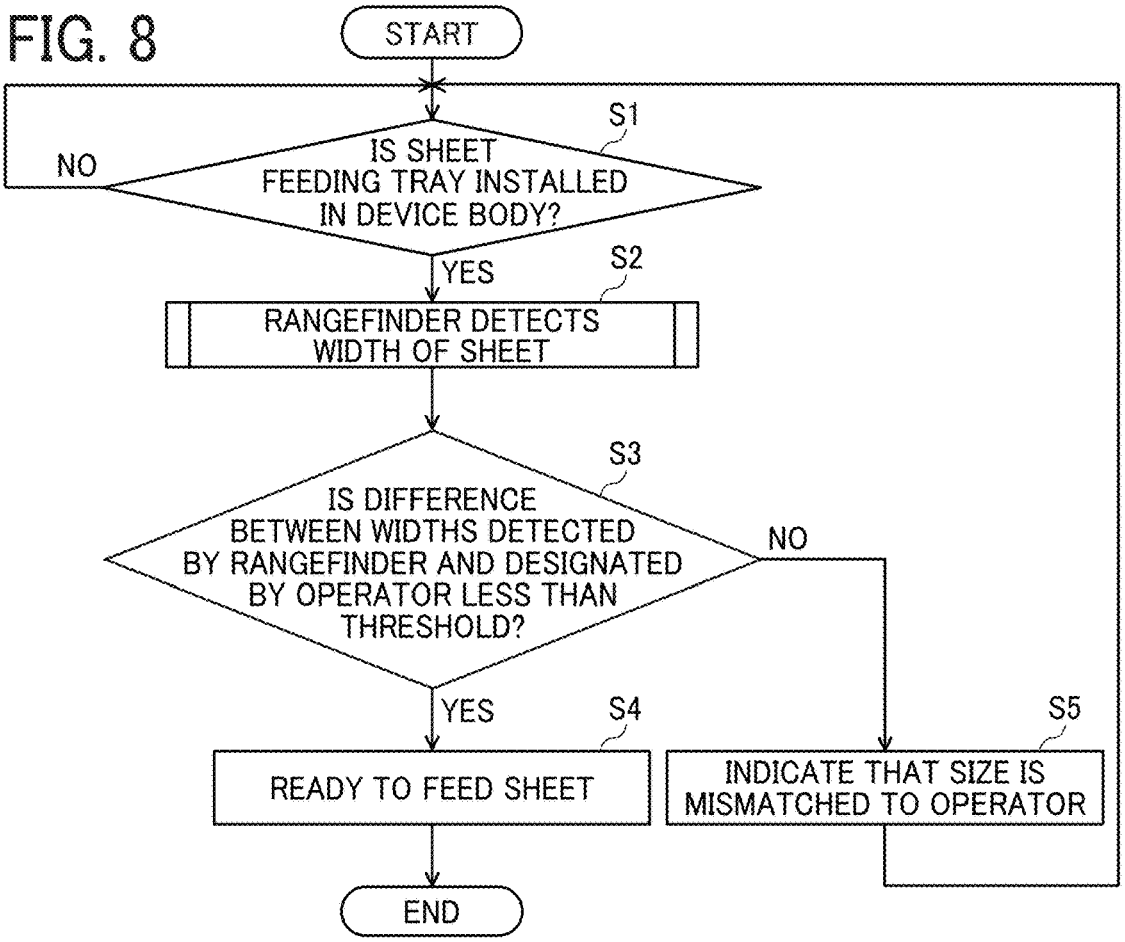
FIG. 8 is a flowchart of a control for determining the positional deviation of the side fence.

FIG. 8 is a flowchart of a control for determining the positional deviation of the side fences 25*a* and 25*b*. When the sheet feeding tray 100 is pushed and installed into the device body of the sheet feeding device 210 (Yes in S1), the rangefinder 50 measures the distance a from the rangefinder 50 to the side fence 25*b*, and the controller 150 of the sheet feeding device 210 calculates the width of the sheet 8, i.e., 2L=2 (a+b) based on the distance a measured by the rangefinder 50 (S2).

Next, the controller 150 compares the calculated width of the sheet 8 with an input sheet width input to the controller 150, which is designated by an operator with a control panel of the image forming system 200 illustrated in FIG. 1, a personal computer (PC) connected to the image forming system 200, or the like.

Figure 9:
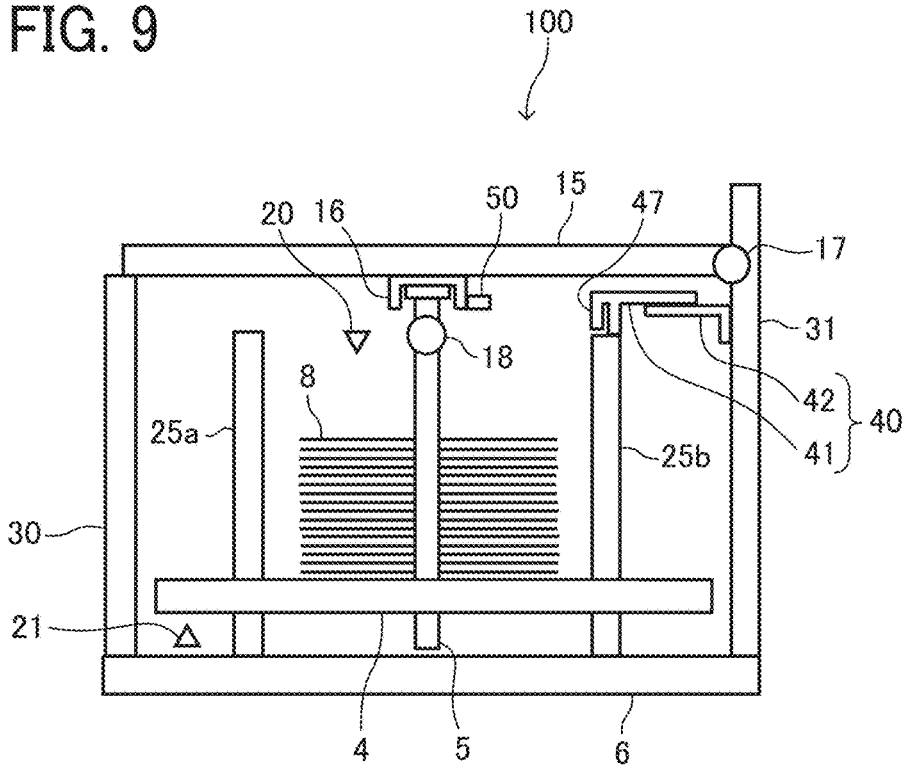
FIG. 9 is a schematic view of the sheet feeding tray in which the side fence does not regulate the position of a bundle of sheets in the width direction.

As illustrated in FIG. 9, after the operator sets the bundle of sheets 8, the operator may install the sheet feeding tray 100 into the device body of the sheet feeding device 210 without the side fences 25*a* and 25*b* being in contact with the edge of the sheets 8 in the width direction. In this case, the difference between the input sheet width designated by the operator and the width of the sheet 8 calculated based on the distance a from the rangefinder 50 to the side fence 25*b* measured by the rangefinder 50 is equal to or greater than a threshold (No in S3).

If the sheet feeding device 210 starts to feed the sheet 8 with the difference of the widths being equal to or greater than the threshold, that is, in the state in which the side fences 25*a* and 25*b* do not regulate the position of the sheets 8 stacked on the lift table 4 in the width direction, the sheet 8 may be fed with a deviation from a predetermined position in the width direction. As a result, an image to be printed on the sheet 8 may be misaligned from a proper position (i.e., a print misalignment occurs). Alternatively, a conveyance failure may occur, and the printing operation of the image forming system 200 may stop.

Therefore, in the present embodiment, when the difference is equal to or greater than the threshold (No in S3), the controller 150, for example, displays a size mismatch information on a display unit such as the control panel or a monitor of the PC to indicate, to the operator, that the width of the sheet 8 calculated based on the distance a measured by the rangefinder 50 is different from the input sheet width designated by the operator (i.e., the difference of the widths is equal to or greater than the threshold) (S5).

When the size mismatch information is indicated to the operator, the operator can recognize that the side fences 25*a* and 25*b* do not regulate the sheet 8 in the width direction, and the operator pulls out the sheet feeding tray 100 again. Then, the operator moves the side fences 25*a* and 25*b* in the width direction and brings the side fences 25*a* and 25*b* into contact with the edge the sheets 8 stacked on the lift table 4 in the width direction to regulate the position of the sheets 8 in the width direction. Accordingly, the conveyance failure and the print misalignment can be prevented.

Preferably, in addition to indicating the size mismatch information, the controller 150 inhibits the sheet feeding device 210 from feeding the sheet 8 in the state in which the side fences 25*a* and 25*b* do not regulate the position of the sheets 8 and the image forming system 200 from performing the printing operation. Accordingly, the conveyance failure and the print misalignment can be more reliably prevented.

On the other hand, when the difference between the input sheet width designated by the operator and the width of the sheet 8 calculated based on the distance a to the side fence 25*b* measured by the rangefinder 50 is less than the threshold (Yes in S3), the side fences 25*a* and 25*b* regulate the position of the sheets 8 stacked on the lift table 4. At that time, the sheet feeding device 210 is ready to feed the sheet 8 (S4).

The embodiments described above are just examples, and the various aspects of the present disclosure attain respective effects as follows.

Aspect 1

A sheet stacker such as the sheet feeding device 210 includes a sheet stacking portion such as the lift table 4, a pair of sheet restrictors such as the pair of the side fences 25*a* and 25*b*, a sheet feeder (in the present embodiment, constructed of the pickup belt 3, the suction fan, and the driver of the pickup belt 3), and a position detector such as the rangefinder 50. A bundle of sheets is stacked on the sheet stacking portion in a stacking direction, and the sheet stacking portion moves in the stacking direction. The pair of sheet restrictors move in a width direction of the bundle of sheets orthogonal to the stacking direction to regulate a position of the bundle of sheets in the width direction. The sheet feeder feeds a top sheet of the bundle of sheets at a sheet feeding position in a sheet feeding direction orthogonal to the stacking direction and the width direction. The sheet feeding position is disposed at a top of the bundle of sheets in the stacking direction. The position detector is disposed between the pair of sheet restrictors in the width direction and above the sheet feeding position in the stacking direction. The position detector detects a position of the pair of sheet restrictors in the width direction.

With this configuration, since the position detector is disposed above the sheet feeding position, the position detector can more reliably detect the position of the sheet restrictor than a position detector that is disposed on the bottom portion of the sheet stacker. That is, unlike the bottom portion, waste adhering to the bundle of sheets such as paper dust does not fall on the upper surface of the bundle of sheets. Accordingly, the waste is less likely to accumulate on the upper surface of the bundle of sheets than on the bottom portion. Even if waste adheres to the upper surface of the bundle of sheets, when the top sheet of the bundle of sheets is fed, the waste adhering to the upper surface of the bundle of sheets is conveyed together with the top sheet. Therefore, unlike the bottom portion, almost no waste accumulates on the upper surface of the bundle of sheets 8. Therefore, the waste does not hinder the position detector from detecting the sheet restrictor. As a result, the position detector can more reliably detect the position of the sheet restrictor than a position detector that is disposed on the bottom portion of the sheet stacker.

Aspect 2

In Aspect 1, the sheet stacker further includes a stay such as the guide rail 16. The stay is disposed at a center of the pair of sheets restrictors in the width direction and above the sheet feeding position. The position detector such as the rangefinder 50 is attached to the stay.

With this configuration, the position detector such as the rangefinder 50 can be disposed between the pair of sheet restrictors and above the sheets stacked on the sheet stacking portion.

Aspect 3

In Aspect 2, the sheet stacker further includes a device body, a trailing-end restrictor such as the end fence 5, and a frame such as the guide frame 15. The trailing-end restrictor regulates the position of the trailing end of the bundle of sheets stacked on the sheet stacking portion such as the lift table 4 in the sheet feeding direction. The frame is swingably attached the device body. The stay such as the guide rail 16 is attached to the frame. The trailing-end restrictor is attached to the stay, and is slidable in the sheet feeding direction.

With this configuration, as described in the above embodiment, since the frame such as the guide frame 15 is swingable, the trailing-end restrictor such as the end fence 5 can be retreated from the center of the device body in the width direction together with the stay such as the guide rail 16. As a result, when the sheet is set on the sheet stacking portion such as the lift table 4, the trailing-end restrictor does not become an obstacle, thereby facilitating sheet setting.

Aspect 4

In any one of Aspects 1 to 3, one of the pair of sheet restrictors such as the side fence 25*b* moves in a first direction and another of the pair of sheet restrictors such as the side fence 25*a* moves in a second direction opposite to the first direction by the same distance in conjunction with each other in the width direction. The position detector such as the rangefinder 50 detects the position of the one of the pair of sheet restrictors.

With this configuration, as described in the above embodiment, since one sheet restrictor and the other sheet restrictor are linked with each other and move by the same distance in opposite directions in the width direction, the position of the other sheet restrictor can also be determined by detecting the position of the one sheet restrictor. As a result, the distance from the one sheet restrictor to the other sheet restrictor can be calculated based on the position of the one sheet restrictor, and the width of the sheets stacked on the sheet stacking portion such as the lift table 4 can be calculated.

Aspect 5

In any one of Aspects 1 to 4, the position detector is a rangefinder such as the rangefinder 50 that measures a distance.

With this configuration, the position of the sheet restrictor in the width direction can be determined based on the distance from the position detector such as the rangefinder 50 to the sheet restrictor such as the side fence 25*b* measured by the position detector.

Aspect 6

In any one of the Aspects 1 to 5, the sheet stacker further includes a fixing unit such as the fixing mechanism 40 that locks the pair of sheet restrictors such as the side fences 25*a* and 25*b* to fix the position of the pair of sheet restrictors in the width direction. The fixing unit includes a detection portion such as the detection portion 47 detectable by the position detector such as the rangefinder 50.

With this configuration, the fixing unit can lock the pair of sheet restrictors such as the side fences 25*a* and 25*b* so as to regulate the position of the sheets stacked on the sheet stacking portion such as the lift table 4 in the width direction. The position of the side fence 25*b* can be detected by detecting the detection portion 47 of the fixing unit.

Aspect 7

In the Aspect 6, the sheet stacker further includes a device body having a side face. The fixing unit such as the fixing mechanism 40 further includes a first component such as the fixing plate 42, a second component such as the slide plate 41, and a fastening member such as the screws 48. The first component is secured to the side face of the device body. The second component is secured to an upper end of one of the pair of sheet restrictors such as the side fence 25*b* and slidably attached to the first component in the width direction. The second component includes the detection portion such as the detection portion 47. The fastening member fastens the second component to the first component.

With this configuration, since the second component such as the slide plate 41 is fastened to the first component such as the fixing plate 42 with the fastening member such as the screws 48, the sheet restrictor such as the side fence 25*b* can be locked to immobilize the pair of sheet restrictors in the width direction. When the screws 48 are loosened, the second component can be moved relative to the first component to move the sheet restrictor in the width direction.

Since the second component attached to the sheet restrictor includes the detection portion, the position detector such as the rangefinder 50 can detect the position of the sheet restrictor by detecting the detection portion.

Aspect 8

In any one of Aspects 1 to 7, the sheet stacker further include circuitry such as the controller 150. The circuitry calculates a width of the bundle of sheets based on the position of the pair of sheet restrictors such as the side fence 25*b* detected by the position detector such as the rangefinder 50, compares the width of the bundle of sheets with an input sheet width input to the circuitry to obtain a difference between the width of the bundle of sheets and the input sheet width, and indicates that the difference is equal to or greater than a threshold.

With this configuration, as described in the above embodiment, the sheet stacked on the sheet stacking portion such as the lift table 4 is prevented from being fed without being regulated in the width direction by the pair of sheet restrictors such as the side fences 25*a* and 25*b*. As a result, the sheet can be prevented from being conveyed with a deviation from a predetermined position in the width direction to prevent the print misalignment and the conveyance failure.

Aspect 9

An image forming system includes the sheet stacker according to any one of Aspects 1 to 8, to feed a sheet with the sheet feeder and an image forming device such as the inkjet printer 230 to form an image on the sheet fed by the sheet feeder of the sheet stacker.

With this configuration, the sheet stacked on the sheet stacking portion can be fed to the image forming device to form an image on the sheet.

As described above, according to the present disclosure, the position detector can reliably detect the position of the sheet restrictor.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet stacker comprising:

a sheet stacking portion on which a bundle of sheets is stacked in a stacking direction, the sheet stacking portion configured to move in the stacking direction;

a pair of sheet restrictors configured to move in a width direction of the bundle of sheets orthogonal to the stacking direction to regulate a position of the bundle of sheets in the width direction;

a sheet feeder configured to feed a top sheet of the bundle of sheets at a sheet feeding position in a sheet feeding direction orthogonal to the stacking direction and the width direction, the sheet feeding position at a top of the bundle of sheets in the stacking direction;

a position detector between the pair of sheet restrictors in the width direction and above the sheet feeding position in the stacking direction, the position detector configured to detect a position of the pair of sheet restrictors in the width direction; and a stay at a center of the pair of sheet restrictors in the width direction and above the sheet feeding position, wherein the position detector is attached to the stay.

2. The sheet stacker according to claim 1, further comprising:

a device body;

a trailing-end restrictor configured to regulate a position of a trailing end of the bundle of sheets stacked on the sheet stacking portion in the sheet feeding direction; and a frame swingably attached to the device body, wherein the stay is attached to the frame, the trailing-end restrictor is attached to the stay, and the trailing-end restrictor is configured to be slidable in the sheet feeding direction.

3. The sheet stacker according to claim 1, wherein a first sheet restrictor of the pair of sheet restrictors is configured to move a first distance in a first direction;

a second sheet restrictor of the pair of sheet restrictors is configured to move, in conjunction with the movement of the first sheet restrictor, the first distance in a second direction opposite to the first direction; and the position detector is further configured to detects the position of the pair of sheet restrictors in the width direction based on a detected position of the first sheet restrictor.

4. The sheet stacker according to claim 1, wherein the position detector is a rangefinder configured to measure a distance.

5. The sheet stacker according to claim 1, further comprising:

a fixing mechanism configured to lock the pair of sheet restrictors to fix the position of the pair of sheet restrictors in the width direction, the fixing mechanism including a detection portion detectable by the position detector.

6. The sheet stacker according to claim 5, further comprising a device body having a side face, wherein the fixing mechanism further includes, a first component secured to the side face of the device body;

a second component secured to an upper end of one of the pair of sheet restrictors and slidably attached to the first component in the width direction, the second component including the detection portion; and a fastening member configured to fasten the second component to the first component.

7. The sheet stacker according to claim 1, further comprising circuitry configured to, calculate a width of the bundle of sheets based on the detected position of the pair of sheet restrictors;

compare the width of the bundle of sheets with an input sheet width input to the circuitry to obtain a difference between the width of the bundle of sheets and the input sheet width; and indicate whether the difference is equal to or greater than a threshold based on results of the comparison.

8. An image forming system comprising:

a sheet stacker configured to feed a sheet with a sheet feeder; and an image forming device configured to form an image on the sheet fed by the sheet feeder, wherein the sheet stacker includes, a sheet stacking portion on which a bundle of sheets is stacked in in a stacking direction, the sheet stacking portion configured to move in the stacking direction, a pair of sheet restrictors configured to move in a width direction of the bundle of sheets orthogonal to the stacking direction to regulate a position of the bundle of sheets in the width direction, a sheet feeder configured to feed a top sheet of the bundle of sheets at a sheet feeding position in a sheet feeding direction orthogonal to the stacking direction and the width direction, the sheet feeding position at a top of the bundle of sheet in the stacking direction, a position detector between the pair of sheet restrictors in the width direction and above the sheet feeding position in the stacking direction, the position detector configured to detect a position of the pair of sheet restrictors in the width direction, and a stay at a center of the pair of sheet restrictors in the width direction and above the sheet feeding position, wherein the position detector is attached to the stay.

9. The image forming system according to claim 8, wherein the sheet stacker further includes:

a device body;

a trailing-end restrictor configured to regulate a position of a trailing end of the bundle of sheets stacked on the sheet stacking portion in the sheet feeding direction; and a frame swingably attached to the device body, wherein the stay is attached to the frame, the trailing-end restrictor is attached to the stay, and the trailing-end restrictor is configured to be slidable in the sheet feeding direction.

10. The image forming system according to claim 8, wherein a first sheet restrictor of the pair of sheet restrictors is configured to move a first distance in a first direction;

a second sheet restrictor of the pair of sheet restrictors is configured to move, in conjunction with the movement of the first sheet restrictor, the first distance in a second direction opposite to the first direction; and the position detector is further configured to detect the position of the pair of sheet restrictors in the width direction based on a detected position of the first sheet restrictor.

11. The image forming system according to claim 8, wherein the position detector is a rangefinder configured to measure a distance.

12. The image forming system according to claim 8, further comprising:

a fixing mechanism configured to lock the pair of sheet restrictors to fix the position of the pair of sheet restrictors in the width direction, the fixing mechanism including a detection portion detectable by the position detector.

13. The image forming system according to claim 12, further comprising:

a device body having a side face, wherein the fixing mechanism further includes, a first component secured to the side face of the device body;

a second component secured to an upper end of one of the pair of sheet restrictors and slidably attached to the first component in the width direction, the second component including the detection portion; and a fastening member configured to fasten the second component to the first component.

14. The image forming system according to claim 8, further comprising:

circuitry configured to, calculate a width of the bundle of sheets based on the detected position of the pair of sheet restrictors;

compare the width of the bundle of sheets with an input sheet width input to the circuitry to obtain a difference between the width of the bundle of sheets and the input sheet width; and indicate whether the difference is equal to or greater than a threshold based on results of the comparison.

15. A method of operating a sheet stacker, comprising:

moving a sheet stacking portion in a stacking direction, the sheet stacking portion including a bundle of sheets stacked in the stacking direction;

regulating a position of the bundle of sheets in a width direction using a pair of sheet restrictors, the regulating including moving the pair of sheet restrictors in the width direction of the bundle of sheets orthogonal to the stacking direction;

feed a top sheet of the bundle of sheets at a sheet feeding position in a sheet feeding direction orthogonal to the stacking direction and the width direction using a sheet feeder, the sheet feeding position at a top of the bundle of sheets in the stacking direction; and detect a position of the pair of sheet restrictors in the width direction using a position detector, the position detector between the pair of sheet restrictors in the width direction and above the sheet feeding position in the stacking direction, wherein the position detector is attached to a stay, the stay at a center of the pair of sheet restrictors in the width direction and above the sheet feeding position.

16. The method according to claim 15, further comprising:

regulate a position of a trailing end of the bundle of sheets stacked on the sheet stacking portion in the sheet feeding direction using a trailing-end restrictor, wherein the stay is attached to a frame, the frame swingably attached to a device body, the trailing-end restrictor is attached to the stay, and the trailing-end restrictor is slidable in the sheet feeding direction.

17. The method according to claim 15, further comprising:

moving a first sheet restrictor of the pair of sheet restrictors by a first distance in a first direction;

moving a second sheet restrictor of the pair of sheet restrictors, in conjunction with the moving of the first sheet restrictor, by the first distance in a second direction, the second direction being opposite to the first direction; and the detecting the position of pair of sheet restrictors being detected based on a detected position of the first sheet restrictor.

18. The method according to claim 15, further comprising:

locking the pair of sheet restrictors to fix the position of the pair of sheet restrictors in the width direction using a fixing mechanism, the fixing mechanism including a detection portion detectable by the position detector.

19. The method according to claim 18, wherein the sheet stacker includes a device body having a side face;

the fixing mechanism further includes, a first component secured to the side face of the device body;

a second component secured to an upper end of one of the pair of sheet restrictors and slidably attached to the first component in the width direction, the second component including the detection portion; and the method further includes, fastening the second component to the first component using a fastening member.

20. The method according to claim 15, further comprising:

calculating a width of the bundle of sheets based on the detected position of the pair of sheet restrictors using circuitry;

comparing the width of the bundle of sheets with an input sheet width input to the circuitry to obtain a difference between the width of the bundle of sheets and the input sheet width; and indicating whether the difference is equal to or greater than a threshold based on results of the comparison.

* * * * *